US005251702A

United States Patent [19]

Vazquez

[11] Patent Number: 5,251,702

[45] Date of Patent: Oct. 12, 1993

[54] SURFACE CONTROLLED SUBSURFACE SAFETY VALVE

[75] Inventor: Gonzalo Vazquez, Houston, Tex.

[73] Assignee: AVA International Corporation, Houston, Tex.

[21] Appl. No.: 730,702

[22] Filed: Jul. 16, 1991

[51] Int. Cl.[5] ..... F21B 34/10

[52] U.S. Cl. ..... 166/324; 166/375

[58] Field of Search ..... 166/72, 321, 324, 375

[56] References Cited

U.S. PATENT DOCUMENTS

| | | | |
|---|---|---|---|
| 3,696,868 | 10/1972 | Taylor, Jr. | 166/375 |
| 3,799,258 | 3/1974 | Tausch | 166/72 |
| 4,149,698 | 4/1979 | Deaton | 166/324 X |
| 4,161,219 | 7/1979 | Pringle | 166/324 |
| 4,325,431 | 4/1982 | Akkerman | 166/117.5 |
| 4,527,631 | 7/1985 | Vazquez | 166/324 X |

FOREIGN PATENT DOCUMENTS

| | | |
|---|---|---|
| 2035414 | 6/1980 | United Kingdom . |
| 2036133 | 6/1980 | United Kingdom . |
| 2036134 | 6/1980 | United Kingdom . |

OTHER PUBLICATIONS

Composite Catalog of Oilfield and Pipeline Equipment pp. 3716-3723 (1978-79).

*Primary Examiner*—David J. Bagnell

*Attorney, Agent, or Firm*—Vaden, Eickenroht, Thompson, Boulware & Feather

[57] ABSTRACT

A surface controlled, subsurface safety valve in which a force due to control pressure fluid from a first source at the surface for opening the valve is opposed in part by a force due to reference pressure fluid from a second source at the surface, whereby the valve closes in response to a fail condition.

6 Claims, 10 Drawing Sheets

SURFACE CONTROLLED SUBSURFACE SAFETY VALVE

This invention relates generally to surface controlled, subsurface valves for providing "fail safe" control within a well string in a well bore, and, more particularly, to improvements in such valves which are normally closed and adapted to be opened by a force due to the supply thereto of a source of pressure fluid at the surface, the exhaustion of such fluid in response to a "fail" condition permitting the valve to close. In one of its aspects, the invention relates to improvements in valves of this type wherein the force for holding the valve open is opposed in part by a force due to the supply thereto of another or second pressure source of fluid at the surface.

In a valve of this general type, a closure member is mounted on a tubular body connectible in the well string for movement between positions opening and closing the bore therethrough by means which includes an actuator having a piston vertically reciprocable with the body to form a pressure chamber above to which control fluid may be supplied in order to move the closure member to open position. The lower end of the piston extends sealably through the body so that the well fluid acts across it to urge the actuator upwardly and thus permit the closure member to move to closed position when the supply of control fluid is exhausted.

The actuator also includes a flow tube which is reciprocable within the bore of the tubular body, in response to raising and lowering of the piston, and spring pressed to its upper position. In the event the valve malfunctions and well fluid enters the pressure chamber as for example, due to loss of the seal through which the piston extends, the valve closes automatically, even though well fluid acts across both ends of the piston, because the upward force of the spring.

The closure member may be a flapper which is spring pressed to closed position and which is engaged by the lower end of the flow tube to move to open position. Alternatively, the closure member may be a ball connected to the lower end of the flow tube as to rotate it between closed and opened positions as the flow tube is raised and lowered.

As shown in U.S. Pat. No. 3,799,258, for example, the piston may surround the flow tube for sealably sliding within an enlarged inner diameter portion of the bore of the tubular body to form an annular pressure chamber between the bore and tube to which control pressure may be supplied. Such a valve may be tubing mounted in that the closure member is mounted on an outer tubular member connectible in the well string. Or, it may be of the wire line retrievable type wherein an inner tubular member in which the bore is formed end on which the closure member is mounted is removably mounted in the outer member, whereby the closure member and inner member may be lowered into or raised from a supported position in the outer member by means of a wireline.

As shown in U.S. Pat. No. 4,161,219, the piston may instead be sealably slidable within a cylinder formed in the body to one side of the bore and extending through the body to engage at its lower end with the flow tube for lowering it. As shown in U.S. Pat. No. 4,325,431, the piston may by sealably slidably within the cylinder of a tool removably mounted in a side pocket in the outer member which opens at one end to its bore, with the lower end of the piston extending through the lower end of the tool and the pocket to engage the flow tube. As explained in such patent, this enables the piston and its seal parts to be retrieved with the tool for replacement or repair separately of the closure member.

Since the actuator is urged upwardly to close the valve by a force due to well fluid acting over the lower side of the piston, it can be moved downwardly to open the valve only by control fluid at a pressure exceeding that of well fluid. Hence, when installed at great depths, such valves require very expensive surface control systems and are highly susceptible to damage due to the high control pressure acting across its seals and pressure connections.

It has been proposed to alleviate this problem by replacing at least a portion of the upward force due to well fluid with an upward force due to pressure fluid from a second source at the surface, thus reducing the downward force on the piston required to open the valve. Thus, as shown for example, on pages 3716–3723 of the 1978–79 issue of the *Composite Catalog of Oilfield and Pipeline Equipment,* such fluid is supplied to a lower annular pressure chamber formed between the lower side of the piston about the flow tube and an enlarged inner diameter portion of the bore through the body of the valve. However, if the lower seal about the rod of the piston fails, or if well fluid otherwise has access to the pressure chamber above the piston, the valve will lock open. That is, as compared with other valves of this general type not having this balance feature, as above described, the valve will not automatically fail closed due to a malfunction of this type.

It is therefore the primary object of this invention to provide a valve of this latter type in which the valve will not be locked open due to leakage of any one seal arranged to prevent the entry of well fluid into the control chamber above the piston.

Another object is to provide such a valve in which the effect of well fluid may be totally or at least partially balanced, so that the valve is insensitive or at least less sensitive to depth.

Still another object is to provide such a valve in which, alternatively, well fluid is used to urge the valve to closed position upon failure.

These and other objects are accomplished, in accordance with this invention, by a valve of this latter type wherein the control chamber is in effect surrounded by pressure fluid from the second source so as to isolate it from the well fluid in the event of such a seal failure. As a result, the valve will "fail" closed and merely revert to a conventional subsurface safety valve of this type whose operation requires a control fluid pressure greater than that of the well fluid.

For this purpose, and as shown in the illustrated embodiments of the invention, the valve includes, as in prior valves of this type, a tubular body connectible in a well string disposable in a well bore, a closure member mounted in the body for opening and closing the bore therethrough, and means including an actuator vertically reciprocable within the body for moving the closure member to open position as it is lowered and moving the closure member as it is raised. More particularly, a piston about the actuator is sealably slidable within the body to form upper and lower pressure chambers in the body, and a rod on the lower end of the piston extends sealably through the body beneath the lower chamber, whereby well fluid urges the piston upwardly, and the upper chamber is connected with a first source of pressure fluid ("control") at the surface to urge the piston downwardly and the lower chamber is connected with a second source of pressure fluid ("reference") at the surface to urge the piston upwardly.

In accordance with this invention, however, means including spaced apart seal means separates the upper chamber from well fluid, and reference fluid is connected with the area intermediate the spaced apart seal means. Thus, well fluid which might enter the control chamber, due to failure of any one of the seals which encloses it, will through the connections of reference fluid with both the control and reference chambers prevent the valve from being locked open as in prior valves of this type.

In accordance with certain embodiments of the invention, a rod on the upper end of the piston extends sealably through the spaced apart seal means and the body of the valve above the upper chamber whereby well fluid urges the piston downwardly as well as upwardly. Thus, depending on relative pressure responsive areas of upper and lower ends of the rod, the valve is at least relatively insensitive to well fluid during its normal operation.

In one such embodiment, the piston surrounds the flow tube and is sealably slidable in an enlarged inner diameter portion of the body to form said upper and lower chambers. In another such embodiment, the piston is sealably slidable in a cylinder formed in the body to one side of the bore, and, more particularly, the body includes an outer member connectible in the well string and having a pocket opening at one end to the bore, and a tool removably disposable in the pocket and in which the actuator piston reciprocates, whereby the actuator is retrievable.

In accordance with an alternative illustrated embodiment, the upper end of the inner member of the body in which a actuator is received encloses the upper control chamber above the piston so that well fluid does not urge the piston downwardly. Consequently, well fluid acting over the lower end of the piston rod will, during normal operation of the valve, assist the spring in raising the actuator and thus closing the valve.

In the drawings, wherein like reference characters are used throughout designated parts:

FIG. 1 is a vertical sectional view of a valve constructed in accordance with one embodiment of the present invention, wherein the actuator is mounted within a tool removably mounted in a side pocket of a tubular member of the body of the valve connectible in a well tubing, and wherein the connection of the sources of control and reference pressure with the pocket intermediate seals about the tool sealably engageable with the pocket are shown in broken lines;

Figure 1:
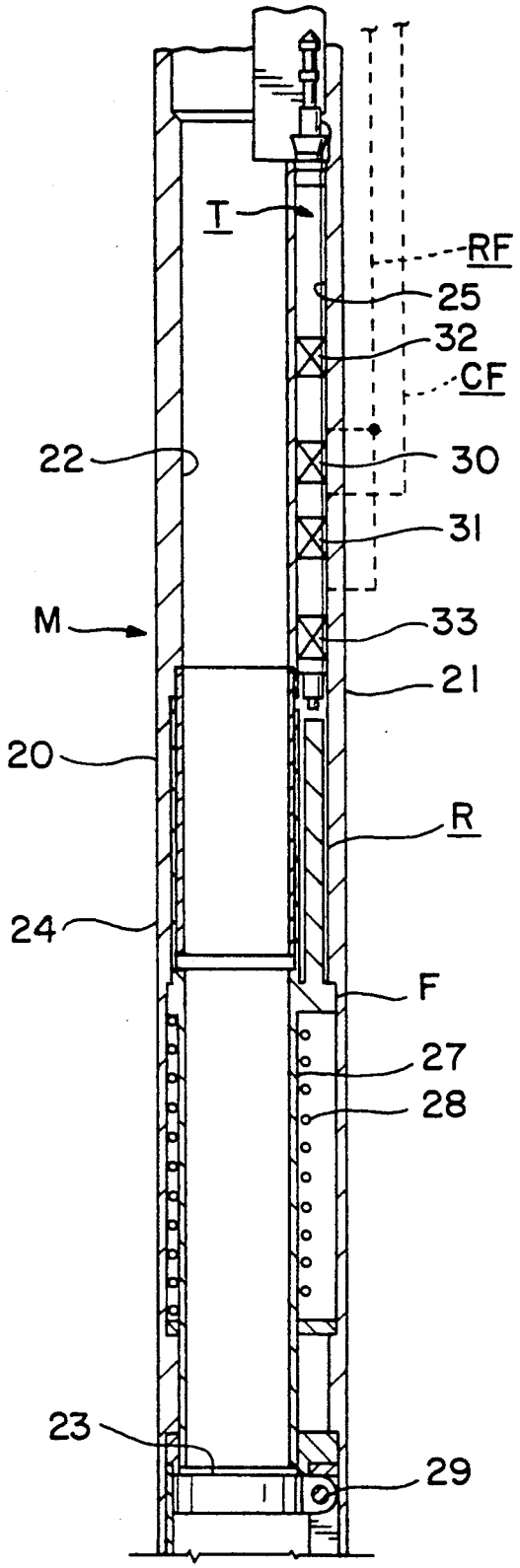

With reference now to the details of the above described drawings, the valve shown in FIGS. 1, 2A, 2B, 3A and 3B, and indicated in its entirety in FIG. 1 by reference character 20, comprises a tubular valve body 21 adapted to be connected its opposite ends as part of a well tubing and a closure member 23 mounted on the body for opening and closing the bore 22 therethrough.

The valve body 21 comprises an outer tubular member 24 connectible in the well tubing and mounting the closure member 23 within the lower end of its bore, and a pocket 25 formed therein and opening to the bore at its upper end. A tool T having a cylinder forming a pressure chamber in which a piston is vertically reciprocable is removably disposable within the side pocket, whereby, as previously mentioned, and as described in detail in the aforementioned U.S. Pat. No. 4,325,431, the seals and piston of the actuator may be removed for replacement or repair.

The actuator also includes a flow tube 27 which is vertically reciprocable within the bore 22 of the body and which is spring pressed to its upper position shown in FIG. 1 by means of a coil spring 28 acting between the flow tube and the body of the valve. Closure member 23 comprises a flapper which is pivotally mounted at 29 on the valve body for movement between positions engaging a seat about the bore of the valve body to close it, as shown in FIGS. 1 and 2B, and a position to one side of the bore, as shown in FIG. 3B, to open the valve. A torsion spring (not shown) on other suitable means yieldably urges the flapper to its closed position.

Figure 2A:
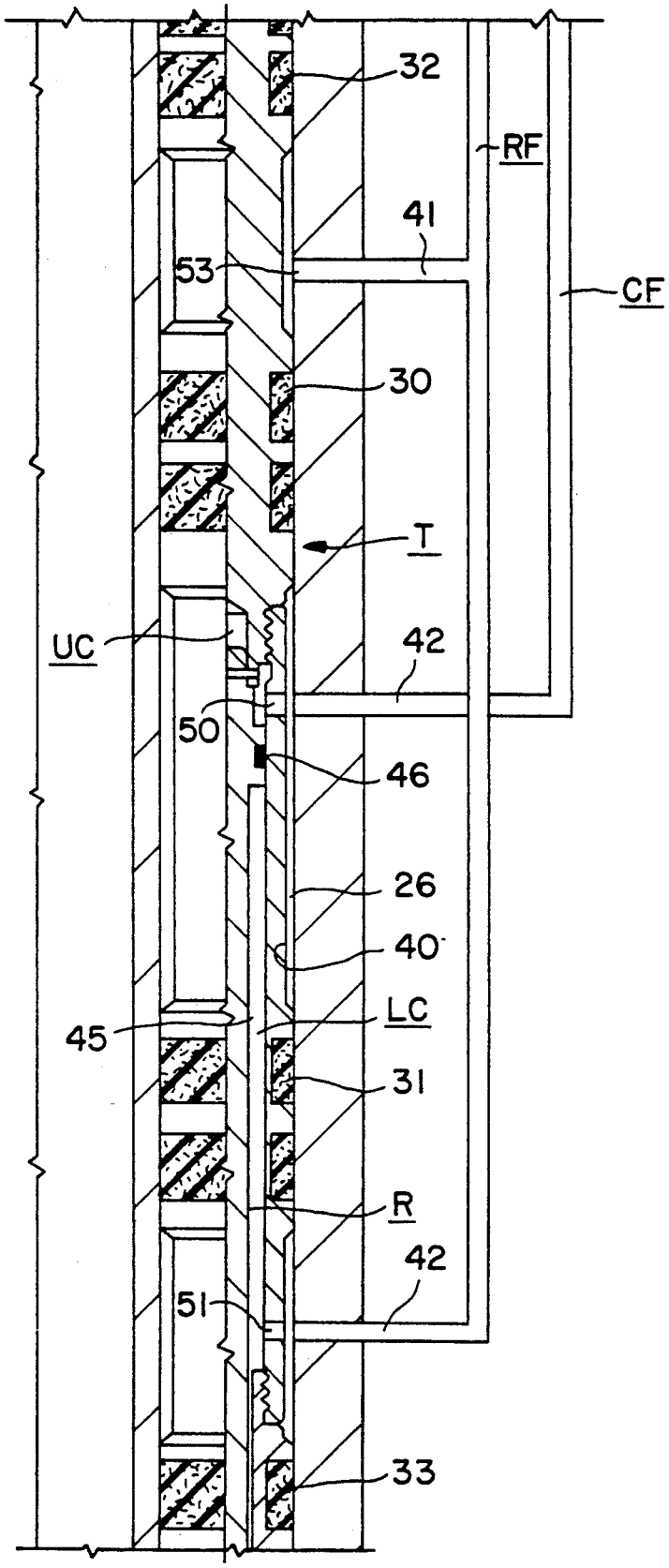
FIGS. 2A and 2B are enlarged half vertical sectional views of the pocket and tool and showing the piston of the actuator raised to the position shown in FIG. 1 to permit the valve to close.
Figure 2B:
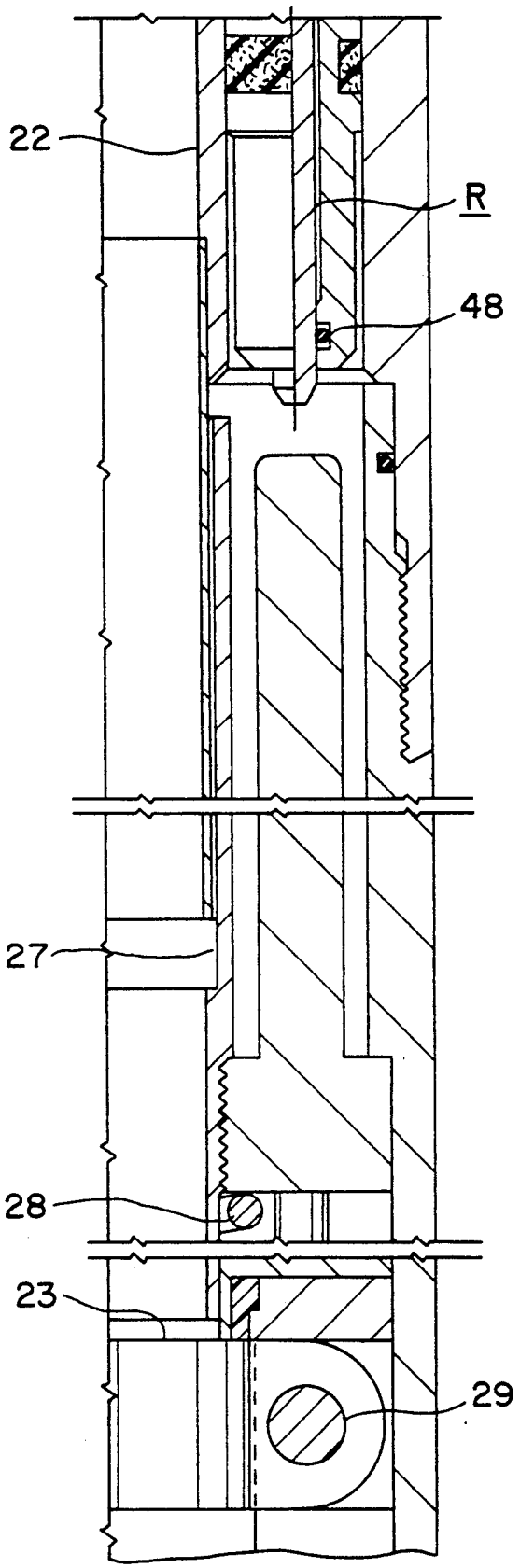
Figure 3A:
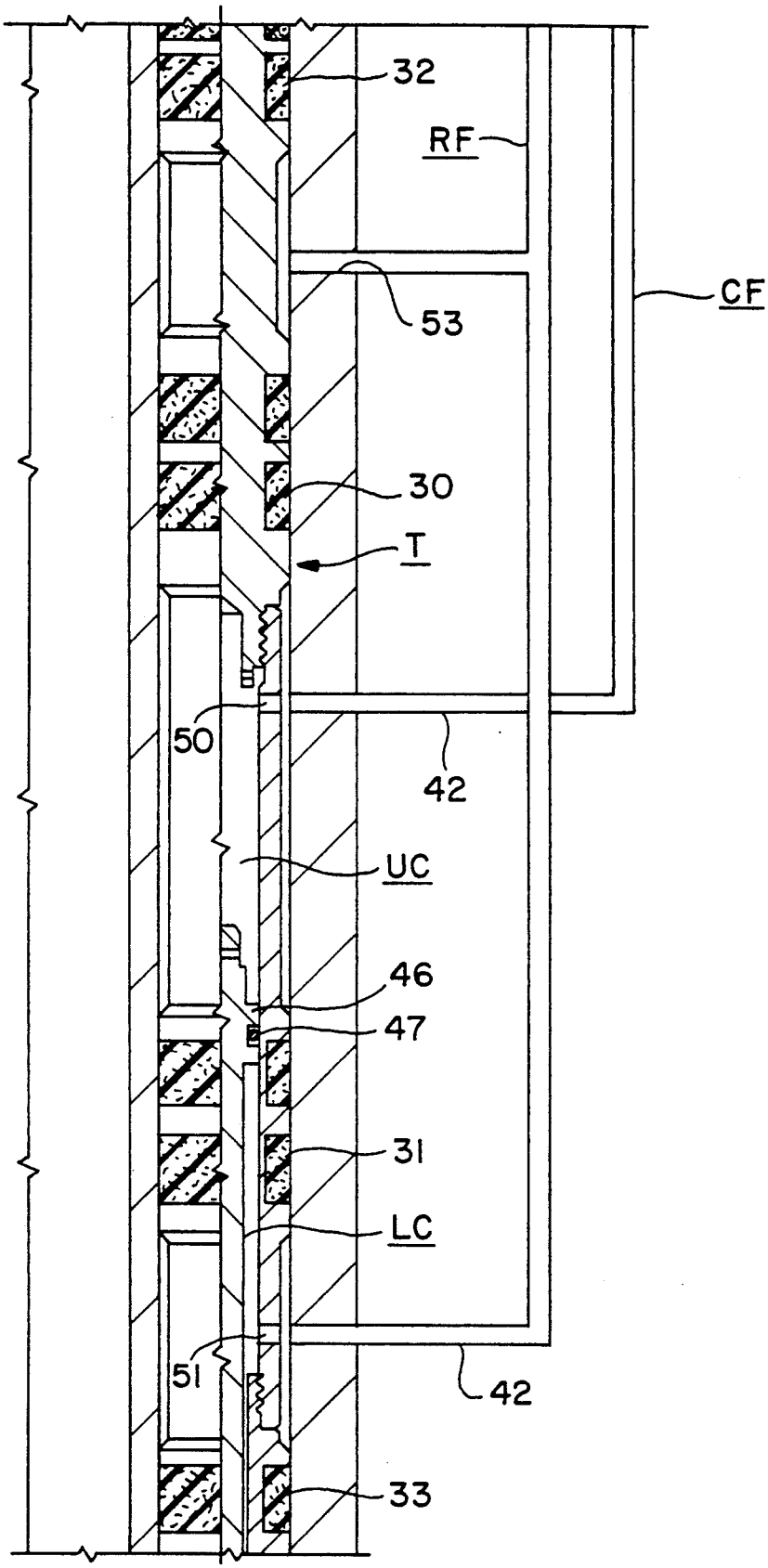
FIGS. 3A and 3B are views similar to FIGS. 2A and 2B, but showing the piston of the actuator lowered to open the valve.
Figure 3B:
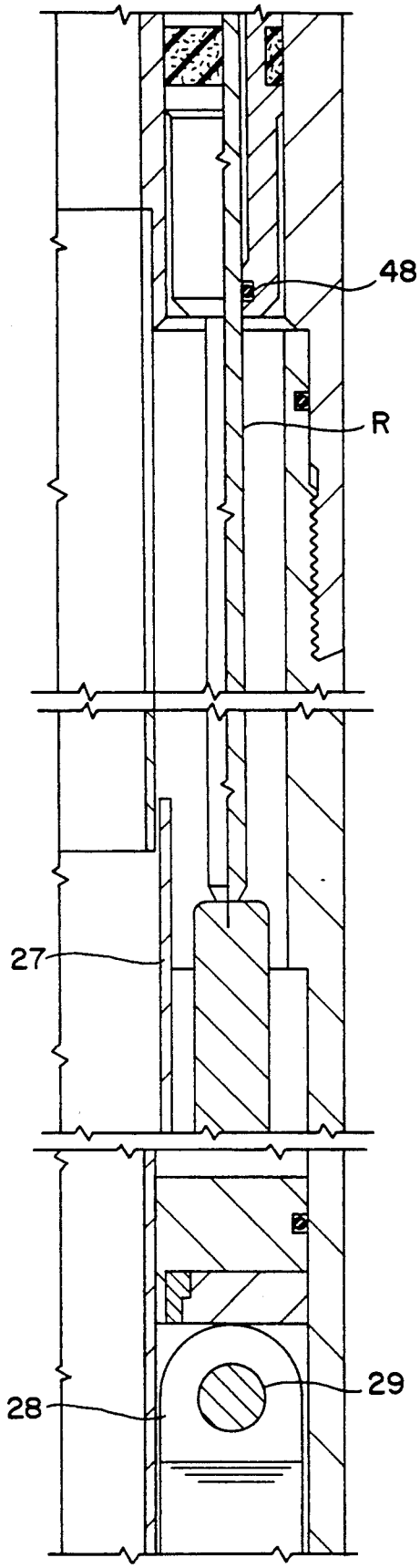

As shown in FIG. 1, 2A and 2B, the actuator piston rod is raised to permit the flow tube 27 to be moved to its upper position in which its lower end is above the flapper to permit it to close. However, upon lowering of the actuator piston, in the manner to be described, the rod on its lower end engages and moves the flow tube downwardly against the force of the spring 28 and thus moves the flapper to the open position of FIG. 3B. As previously mentioned, and as will be described, this downward movement of the lower rod of the actuator piston is responsive to the supply of control fluid to a pressure chamber on the upper end of the piston. Conversely, upon exhaustion of this fluid, as for example in the case of a failed condition, the piston is raised due to the force of well fluid acting across it and the force of the spring on the flow tube to permit the flapper to close.

Control fluid is supplied to the pressure chamber above the actuator piston through a control line CF which connects with the pocket of the outer body member between the sealing engagement therewith of intermediate and lower seals 30 and 31 carried about the tool T. Reference fluid, on the other hand, is supplied to a pressure chamber in the cylinder beneath the piston through one branch of a conduit RF connecting with the pocket between the sealing engagement of the lower intermediate seal 31 and a lowermost seal 33 about the tool. Still further, another branch of conduit RF connects with the pocket intermediate the sealing engagement of seal 30 and upper most seal 32, which normally separates the upper pressure chamber from well fluid in the pocket above tool T.

As shown in FIGS. 2A, 2B and 3A, 3B, the removable tool comprises a housing 40 adapted to fit closely within the side pocket and having the seals 30 to 33 carried thereabout, and an upper port 41 is formed in the outer tubular member of the body to connect the upper branch of the reference fluid conduit with the pocket intermediate seals 30 and 32. Another port 42 is formed therein to connect the lower branch of the reference fluid conduit with the pocket intermediate the seals 31 and 33, and a further port 42 is formed therein to connect the control fluid conduit CF with the pocket intermediate the seals 30 and 31.

More particularly, the tubular housing of the tool has a cylindrical bore 45 formed therein which is closed at its upper end and open at its lower end beneath the seal 33, and the actuator includes a piston 46 having a seal ring 47 thereabout sealably slidable in the cylindrical bore to form an upper control chamber UC thereabove, and a rod R on its lower end which extends sealably through a seal ring 48 about the lower end of the bore to form a lower annular reference chamber LC beneath the piston.

A port 50 formed in the housing of the tool connects its outer diameter intermediate the seals 30 and 31 with the upper chamber UC, whereby control fluid is effective to urge the piston downwardly in a direction to open the valve. Another port 51 is formed in the housing of the tool to connect the lower chamber LC with reference fluid which urges the piston upwardly in a direction to permit the valve member to close. The seals 32 and 30 are of equal outer diameter so that the reference fluid admitted through the port 53 does not act on the actuator to urge it either up or down.

During normal operation, therefore, control fluid will be admitted to the upper chamber UC at a pressure which provides a downward force sufficient to overcome the upward force of well fluid acting on the rod and reference fluid acting on the lower side of the piston in the lower chamber LC and thus lower the rod to open the valve. In the event of exhaust of control fluid, as may occur because of a failed condition, the upward force to the reference fluid as well as well fluid will raise the piston upwardly to permit the valve to close.

However, as previously described, in the event of admission of well fluid to either of the upper and lower pressure chambers, as for example, upon failure of one of the above described seals, the valve will, if in its open position, automatically move to closed position and remain in such position until the actuator piston is moved downwardly by a control pressure higher than that of well fluid pressure. Thus, for example, upon the loss of seal ring 48, well fluid will enter the lower chamber LC to move the piston upwardly in the direction to permit the valve to close. However, in the event of loss of the upper intermediate seal 30, pressure in the upper and lower chambers will equalize to that of reference fluid, and well fluid is effective to move the actuator piston upwardly. On the other hand, upon loss of the upper most seal 32, well fluid will enter the reference fluid conduit and thus the upper and lower chambers, whereby the piston is raised by the spring urging the flow line upwardly.

As previously mentioned, since the upper end of control chamber UC is closed, well fluid is effective, during normal operation, to provide an unopposed force urging the piston rod upwardly to permit the valve to close. This is useful, for example, when well pressure assist is desired in order to close the valve.

Figure 6:
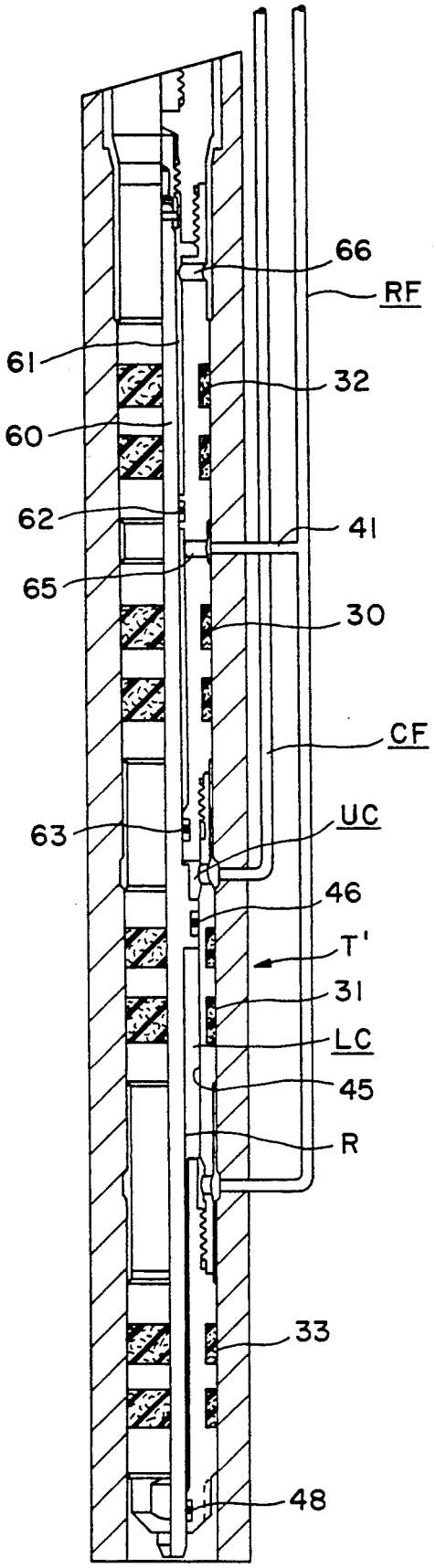
FIG. 6 is a vertical sectional view, interrupted along its length, of parts of a further alternative embodiment of a valve of the type illustrated in FIGS. 1, 2A, 2B, 3A and 3B, wherein the actuator is of such construction so as to be relatively insensitive to well fluid.

The embodiment of the valve shown in FIG. 6, is of the type above described in connection with FIGS. 1, 2A, 2B and 3A, 3B, and in fact, is comprised of many parts identical thereto. These identical parts which include the side pocket 25 in the outer tubular member are referred to by the same reference characters, and the following description will therefore be devoted to the differences rather than the similarities between the two valve embodiments.

As shown in FIG. 6, the alternative valve includes a tool T′ removably disposable in the pocket which differs from tool T′ of the prior embodiment in that a rod 60 extends upwardly from the piston into an upper extension 61 of the cylindrical bore in the tubular housing of the tool. More particularly, rod 60 extends through upper and lower seal means 62 and 63 carried about the extended bore for sealably engaging the rod 60 respectively above and below a port 65 formed in the housing of the tool. More particularly, the port connects with the outer diameter of the housing intermediate the sealing engagement of uppermost seal means 32 and upper intermediate seal means 30 with the pocket. Hence, the port 65 connects with the port 41 formed in the outer tubular member of the body of the tool to which the upper branch of the reference fluid conduit RF is connected.

Also, a port 66 connects the upper end of the extended bore with the pocket and thus with well fluid above the upper end of the tool, the seal means 30 and 32 thus separating the area between spaced seals 62 and 63 from well fluid above the pocket. Thus, this valve will function during normal operation in the same way described in connection with the valve of FIGS. 1, 2A and 2B and 3A, 3B, except that since well fluid acts over rods at both ends of the actuator, the valve is at least relatively insensitive to well fluid pressure. That is, there is little or no upward force due to well fluid urging the piston upwardly to permit the valve closed, and in fact none as long as seals 48 and 62 seal about equal diameter portions of the rods. In other respects, this valve also functions in the same manner previously described in connection with the other valve, in that failure of one or more of the seals, including the seal 63, will cause the valve to close.

As previously mentioned, the valve shown in FIGS. 4A and 4B and 5A and 5B, is of an alternative type in which the piston of the actuator is mounted about the flow tube whose bore forms a continuation of the flow path through the tubing in which the valve is connected. More particularly, the valve includes a body 81 having an outer tubular member 82 which is connectible in the well string and an inner tubular member 83 which is removably mounted in the bore of the outer tubular member to permit it to be run into or raised from within the outer tubular member by means of a wireline.

Figure 4A:
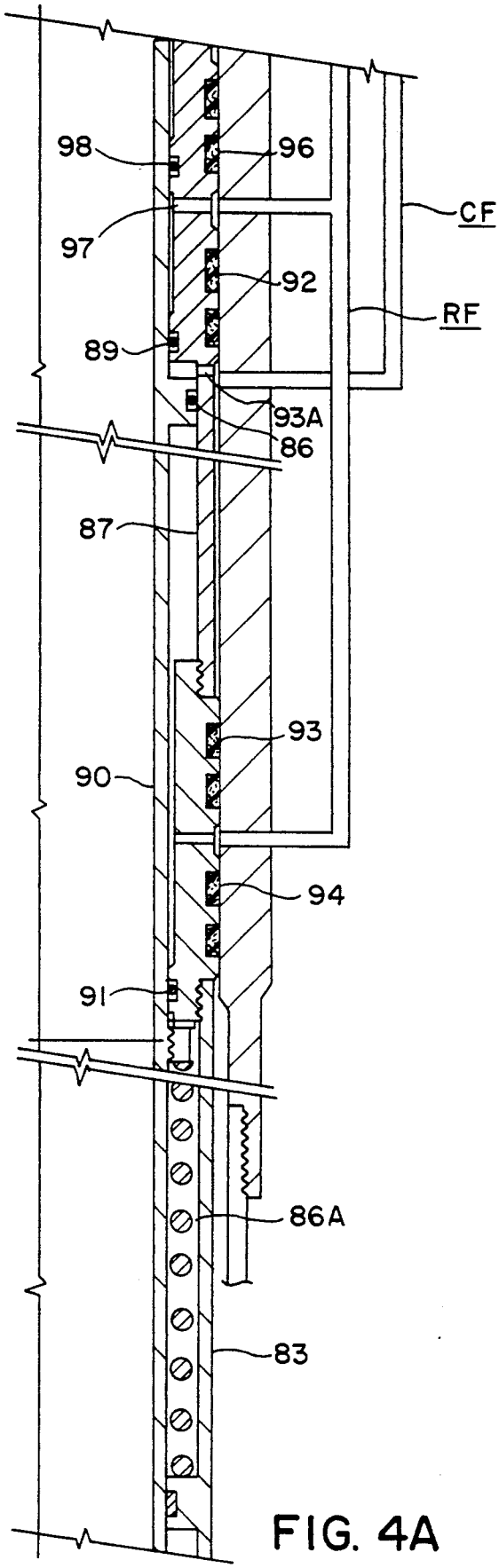
FIGS. 4A and 4B are vertical sectional views of parts of an alternative embodiment of the valve of the wireline retrievable type in which the piston of the actuator surrounds the flow tube for reciprocation within an enlarged inner diameter of the bore of the body of the valve.
Figure 4B:
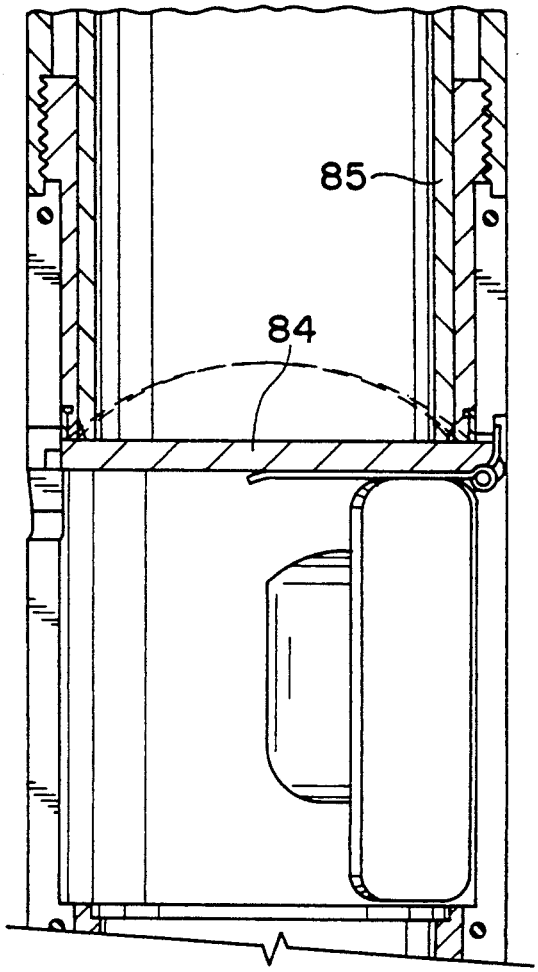
Figure 5A:
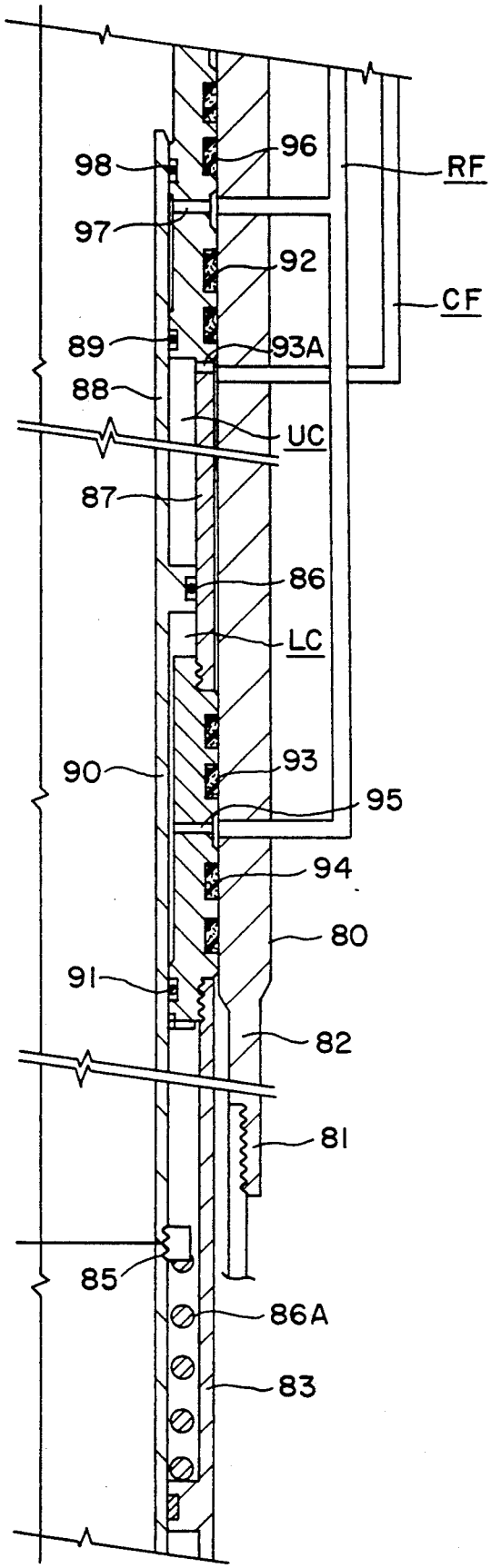
FIGS. 5A and 5B are views similar to 4A and 4B, but with the actuator piston lowered to move the valve to open position.
Figure 5B:
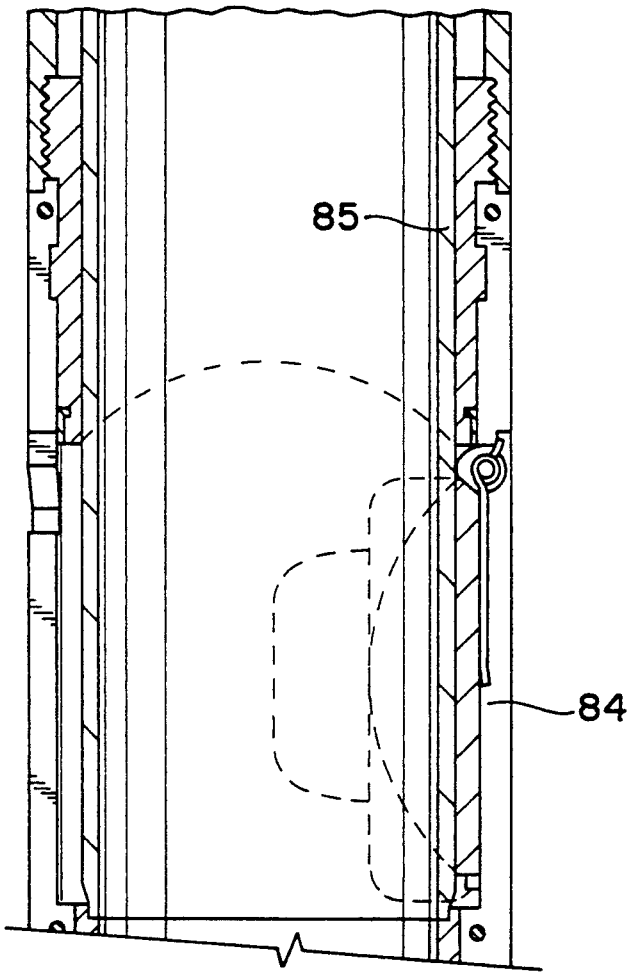

More particularly, a flapper type closure member 84 is pivotally mounted on the inner tubular member for swinging between a position across a seat about the bore to close it, as shown in FIG. 4B, and a position to one side of the bore to open it, as shown in FIG. 5B. The flapper is spring pressed toward closed position and is adapted to be moved downwardly to open position by lowering of a flow tube 85 vertically reciprocable within the bore of the inner tubular member, and to open upon raising of the flow tube under the urging of coil spring 86A.

As previously described, a piston 86 is mounted about the flow tube 85 for sealably sliding within an enlarged inner diameter portion 87 the inner member of the body. More particularly, upper hollow rod 88 of the flow tube is sealably slidable within a seal ring 89 carried about an upper reduced diameter portion of the inner member of the body, and a lower hollow rod 90 sealably slidable within a seal ring 91 carried by a lower reduced diameter portion of the inner member of the body beneath the piston 86. Thus, the flow tube and body form an upper annular chamber UC above piston 86 and a lower annular chamber LC below piston 86.

Upper and lower intermediate seals 92 and 93 respectively are carried about the inner tubular member to seal with respect to the bore of the outer tubular member above and below the connection of the control fluid CF therewith. More particularly, a port 93A is formed in the inner tubular member to connect with its outer diameter intermediate the seals 92 and 93 and thus connect the control fluid conduit CF with the upper chamber UC.

Additional seals 93 and 94 are carried about the outer diameter of the inner tubular member, and a port 95 connects the lower extension of the reference fluid conduit RF with the bore of the outer tubular member intermediate the seals 93 and 94 and thus with the lower pressure chamber LC. Thus, reference fluid will, during normal operation of the valve, act upon the lower end of the piston 86 in chamber LC and thus in opposition to the control fluid acting on the upper side of the piston in chamber UC, whereby, as in the case of the previously described valves, both the control fluid and reference fluid may be at a pressure substantially less than well fluid pressure.

Uppermost seals means 96 is carried about the inner tubular member for sealably engaging the bore of the outer tubular member above and below the connection of the upper branch of reference fluid conduit RF with the bore. Additionally, a port 97 is formed through the inner tubular member to connect its outer diameter intermediate seals 92 and 96 with its inner diameter intermediate seal ring 89 and a seal ring 98 carried about the inner diameter of the inner tubular member to sealably engage about the upper end of the upper flow tube extension 88. Thus, the spaced apart pairs of seals 89 and 98 and 92 and 96 separate the upper chamber from well fluid, and the reference fluid is connected to the area between each such pair.

During normal operations, this valve will thus function in substantially the same way as the previously described valves, in that it will automatically close upon loss of one of the seals enclosing the control chamber. Furthermore, as in the valve of FIG. 6, well pressure assists in urging the valve to its closed position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A surface-controlled, subsurface safety valve comprising a tubular body connectible in a well string disposable in a well bore and having a bore therethrough, a closure member mounted on the body for opening and closing the bore, means forming a cylinder in the body to one side of the bore, means including an actuator having a piston sealably slidable in the cylinder and vertically reciprocable in the cylinder to open the closure member as it is lowered and close the closure member as it is raised, spaced-apart means sealing between the actuator and cylinder to separate a first pressure chamber above the piston from well fluid above the cylinder, means for connecting a first source of pressure fluid at the surface with the first pressure chamber to urge the actuator downwardly, means sealing between the actuator and the cylinder to form a second pressure chamber below the piston, and means for connecting a second source of pressure fluid at the surface with the second pressure chamber to urge the actuator upwardly and with the area between the spaced-apart sealing means, the lower end of the actuator beneath the second sealing means being acted upon by well fluid below the cylinder.

2. A surface-controlled, subsurface safety valve as in claim 1, wherein the upper end of the actuator extends through the spaced-apart first seal means so as to be acted upon by well fluid above the cylinder.

3. A surface-controlled, subsurface safety valve as in claim 1, wherein the upper end of the actuator extends into an upper chamber in the cylinder above the piston so as to be acted upon by first pressure fluid.

4. A surface-controlled, subsurface safety valve comprising a tubular body connectible in a well string disposable in a well bore and having a bore therethrough and a pocket to one side of the bore having an end which opens to the bore, a closure member mounted on the body for opening and closing the bore, a tool adapted to be raised and lowered through the bore fore removable disposal in the pocket, said tool having a cylinder therein and means including a rod having a piston sealably slidable in the cylinder and vertically reciprocable in the cylinder to open the closure member as it is lowered and close the closure member as it is raised, spaced-apart means sealing between the rod and cylinder to separate a first pressure chamber in the cylinder above the piston from well fluid above the tool, means for connecting a first source of pressure fluid at the surface with the first pressure chamber to urge the rod downwardly, means sealing between the rod and the cylinder to form a second pressure chamber in the cylinder below the piston, and means for connecting a second source of pressure fluid at the surface with the second pressure chamber to urge the rod upwardly and with the area between the spaced-apart sealing means, the lower end of the rod beneath the second sealing means being acted upon by well fluid below the cylinder.

5. A surface-controlled, subsurface safety valve as in claim 4, wherein the upper end of the rod extends through the spaced-apart first seal means so as to be acted upon by well fluid above the cylinder.

6. A surface-controlled, subsurface safety valve as in claim 4, wherein the upper end of the rod extends into an upper chamber in the cylinder above the piston so as to be acted upon by first pressure fluid.

* * * * *